US008146759B2

(12) United States Patent
Brown et al.

(10) Patent No.: US 8,146,759 B2
(45) Date of Patent: Apr. 3, 2012

(54) FULLY VENTED WIDE RIM NURSING BOTTLE WITH CANTED VENT TUBE

(75) Inventors: Craig E. Brown, Mt. Zion, IL (US); Robert J. Brown, Chesterfield, MO (US)

(73) Assignee: New Vent Designs, Inc., Mount Zion, IL (US)

( * ) Notice: Subject to any disclaimer, the term of this patent is extended or adjusted under 35 U.S.C. 154(b) by 470 days.

(21) Appl. No.: 12/321,439

(22) Filed: Jan. 21, 2009

(65) Prior Publication Data

US 2010/0181276 A1 Jul. 22, 2010

(51) Int. Cl.
*A61J 9/04* (2006.01)

(52) U.S. Cl. ..... 215/11.5; 215/11.1

(58) Field of Classification Search ..... 215/388, 215/11.5, 11.1, 11.4; 222/464.1, 464.3, 464.7
See application file for complete search history.

(56) References Cited

U.S. PATENT DOCUMENTS

| | | | | |
|---|---|---|---|---|
| 189,691 | A | | 4/1877 | Briere |
| 345,518 | A | | 7/1886 | Lelievre |
| 380,835 | A | | 4/1888 | Ware |
| 598,231 | A | | 2/1898 | Roderick |
| 679,144 | A | | 7/1901 | Hardesty |
| 834,014 | A | | 10/1906 | Lyke |
| 927,013 | A | | 7/1909 | Van Cleave |
| 976,607 | A | | 12/1910 | Van Cleave |
| 1,037,309 | A | | 9/1912 | Poor |
| 1,441,623 | A | | 1/1923 | Davenport |
| 1,600,804 | A | | 9/1926 | Donaldson |
| 1,991,720 | A | * | 2/1935 | Barreda et al. ..... 222/464.2 |
| 2,014,236 | A | | 9/1935 | McNamara |
| 2,061,477 | A | | 11/1936 | Perry |
| 2,156,313 | A | | 5/1939 | Schwab |
| 2,239,275 | A | | 4/1941 | Schwab |
| 2,365,585 | A | | 12/1944 | Paxman |
| 2,610,755 | A | | 9/1952 | Gits |
| 2,742,168 | A | | 4/1956 | Panetti |
| 2,744,696 | A | | 5/1956 | Blackstone |
| 3,059,707 | A | | 10/1962 | Wilkenson et al. |
| 3,112,837 | A | | 12/1963 | Manoyian |
| 3,120,330 | A | | 2/1964 | Ermecke |
| 3,254,809 | A | | 6/1966 | Breneman |
| 3,355,047 | A | | 11/1967 | De Sole |
| 4,386,696 | A | | 6/1983 | Goncalves |
| 4,757,911 | A | | 7/1988 | Larkin |
| 4,930,645 | A | | 6/1990 | Warehime |

(Continued)

FOREIGN PATENT DOCUMENTS

| | | |
|---|---|---|
| DE | 19601198 | 7/1997 |

(Continued)

*Primary Examiner* — Tri Mai
(74) *Attorney, Agent, or Firm* — Paul M. Denk

(57) ABSTRACT

A nursing bottle formed of a large volume container, incorporating a vent tube that extends to vent pressure at all times. The nursing bottle may have a cylindrical shape or other configuration that prevents formula placed therein from blocking the vent tube regardless of its angular disposition. The vent tube extends distally from the vent insert, operatively associated with a collar, that holds the vent structures and the nipple to the wide rimmed opening. In addition, the vent tube has a conical shape of decreasing diameter distally toward the center of the bottom to dissipate the pressure that may cause leakage from the bottle. Further, the vent insert has a major and minor seal that prevents leaks out of the collar and onto an infant.

9 Claims, 11 Drawing Sheets

U.S. PATENT DOCUMENTS

| | | | | | |
|---|---|---|---|---|---|
| 4,944,704 | A | * | 7/1990 | Grace | 446/74 |
| 5,054,660 | A | | 10/1991 | Sherman et al. | |
| D330,084 | S | * | 10/1992 | Kwang | D24/198 |
| 5,269,444 | A | | 12/1993 | Wright | |
| 5,316,160 | A | | 5/1994 | Cautereels | |
| 5,352,052 | A | | 10/1994 | Kaufmann | |
| 5,449,098 | A | | 9/1995 | Offman | |
| 5,678,710 | A | | 10/1997 | Sheu | |
| 5,953,763 | A | | 9/1999 | Gouget | |
| 6,793,094 | B2 | | 9/2004 | Turnbough | |
| 7,150,370 | B2 | | 12/2006 | Pyun | |
| 2005/0236353 | A1 | * | 10/2005 | Hsu | 215/11.5 |

FOREIGN PATENT DOCUMENTS

| | | |
|---|---|---|
| GB | 273185 | 6/1927 |
| GB | 454053 | 9/1936 |
| SE | 82001470 | 1/1982 |

* cited by examiner

FULLY VENTED WIDE RIM NURSING BOTTLE WITH CANTED VENT TUBE

CROSS-REFERENCE TO RELATED APPLICATION

This provisional application for patent is related to the non-provisional patent application Ser. No. 11/258,966 which was filed on Oct. 25, 2005, which claims priority to the non-provisional patent application Ser. No. 11/152,320 which was filed on Jun. 14, 2005, which claims priority to the non-provisional patent application having Ser. No. 10/283,878 which was filed on Oct. 30, 2002; which was filed during the pendency of PCT application Serial No. US01/14,365 which was filed on May 4, 2001 designating the U.S.; and which claimed priority to U.S. provisional application Ser. No. 60/202,851 filed on May 8, 2000.

BACKGROUND OF THE INVENTION

The fully vented wide rim nursing bottle with canted vent tube relates generally to infant serving products. More specifically, the present invention refers to angled nursing bottles having an internal tube that prevents a vacuum within the bottle and assists an infant to suck liquid from the bottle.

A unique aspect of the present invention is an expanding diameter venting tube at an angle to the horizontal that matches the angle of a nursing bottle and provides for its full venting during both usage and storage.

Babies have the instinct to suckle milk from their mothers. For a variety of reasons though, babies often drink liquids from other sources. Babies lack the ability to drink from ordinary glasses and cups without spilling. So, liquids are fed to babies using baby or nursing bottles. A nursing bottle features a silicone, latex, rubber or other material as a nipple with a hole in its tip secured across an opening in the top of the nursing bottle. The current nursing bottle gets used by filling the bottle with a liquid, inserting the vent tube, securing the nipple, inverting the bottle, and placing the nipple into the baby's mouth and the baby takes it from there.

Nursing bottles, vented at the rim of the nipple, are tightly sealed but for the opening in the nipple. As the baby nurses, the volume of liquid in the bottle decreases and the vacuum in the bottle increases proportionally thereby contaminating the liquid. However, vent tubes allow ambient air to enter the bottle generally behind the liquid while the baby suckles. The vent tubes reduce any vacuum created by the suckling baby within the bottle. The vacuum is continuously and automatically vented. The vent tube improves the flow of liquid out of the nipple and makes it easier for the baby to suckle. The baby faces less risk of sucking in air and the resulting colic.

Infant and infant feeding containers originally had a narrow superior orifice to which the nipple was attached. Caregivers noted that the narrow opening prevented ready access to the interior of the bottle and prevented easy cleaning of the interior of the bottle. Manufacturers then addressed that shortcoming with bottles having larger diameter openings. Those bottles met with sales success on the marketplace.

The larger openings called for manufacturing and usage of nipples and feeding spouts with larger diameter flanges to mate with the opening of the bottle. The larger diameter flanges prevented leaks where the nipples joined to the bottles. However, the larger diameter nipples, retaining the same distance from the superior to the inferior end of the nipple, had a larger volume contained by the nipples.

Further, infants often chew upon nipples though nipples remain designed for suckling to remove fluid from a bottle.

Nipples and other feeding accessories therefore have toughened designs to resist chewing. Chewing of nipples arises more often in infants with feeding problems, such as neurological delays or deficits. The neurological delays induce a frequent chewing motion by the infant upon objects placed in the mouth, often nipples.

During frequent chewing on the feeding nipple, especially those with larger diameters and internal volumes, the infant propels air distally into the bottle itself. Air introduced into the bottle may increase the pressure upon the interior of the bottle. The increased pressure frequently forces liquid distally into a venting tube located within the bottle. The liquid under pressure traverses the vent insert and the vent tube, exits the bottle, and causes liquid to spill from the bottle.

Leakage from chewing also arises when introduced air stops midway within a cylindrical vent tube. This arises when an infant forces air down upon the feeding liquid and up through the venting tube. Due to the pressures within the cylindrical vent tube, some liquid may be entrapped in the vent tube by an air bubble caused by an infant chewing. The air bubble must be forced out, ideally as it normally enters the tube when the bottle is inverted and in a feeding position for the infant. The air bubble in the venting tube prevents the feeding liquid from entering the reservoir thereby preventing venting.

However, an air bubble trapped in a vent tube makes the liquid in the distal portion of the vent tube unable to traverse the vent tube and exit into the reservoir. The liquid fails to enter the enlarged reservoir portion of the feeding tube for proper venting by the vent tube. Alas, feeding liquid may then impede the venting function of the tube.

Many attempts have been made to provide a nursing bottle with an air vent to reduce the creation of a vacuum during suckling. An early patent to Roderick, U.S. Pat. No. 598,231 has a nursing bottle with a U shaped tube. However, the average baby, upon uplifting a bottle, had some liquid retained in the U shaped tube. The retained liquid blocked the tube and prevented ambient air from releasing any vacuum within the bottle. Other patents show related types of technology, and provide means for venting air from the interior of a container, as can be seen in the U.S. patent to Van Cleave, U.S. Pat. No. 927,013. In addition, the patents to Davenport, U.S. Pat. No. 1,441,623 and to Perry, U.S. Pat. No. 2,061,477, show other means for venting air from within a nursing bottle.

In the preceding work of these applicants, U.S. Pat. Nos. 5,779,071 and 5,570,796, venting and internal tubes prevent the formation of partial vacuums during suckling and resisted spills. The '071 patent provides a vented tube and extending into a bottle and a reservoir. The vented tube has a hollow cylindrical shape projecting sufficiently downwardly into the bottle. The '796 patent provides a reservoir located above a mark on the bottle. The reservoir communicates with a conduit system to replace suckled liquid with air from the reservoir thus preventing a partial vacuum in the bottle. Nursing bottles of a multitude of designs are available in the prior art. In many instances, frequently a vacuum will be generated within the bottle during dispensing of its contents, as when nursing an infant. A vacuum is believed to cause various physiological impairments to the infant when subjected to this type of condition. The vacuum generated within the bottle, due to the infant's sucking, can cause pressure imbalance at the location of various features of the body, such as in the ear canal, and which may lead to fluid, ear infection, speech delay, motor delay, developmental delay, illness, or other predicaments. Thus, the presenting of a nursing bottle that incorporates air venting means, so as to prevent the creation of a vacuum inside the bottle, has been considered a desirable development in the field of infant serving products. Such can be seen in the applicants' prior patents '071 and '769, wherein the reservoir tube that provides for venting, externally of the bottle cap at an upper proximity, extends into the lower portion of the container, to function as a vent while the contents of the bottle are being consumed, when partially or fully inverted.

The current invention, on the other hand, provides means for venting of any vacuum within an angled bottle, and to prevent the generation of any vacuum or pressure therein, regardless whether the nursing bottle is being used, stored in an upright position, or partially or fully inverted as during consumption of its contents.

Other U.S. patents that relate to the subject matter of this invention include the U.S. patent to Briere, U.S. Pat. No. 189,691; U.S. Pat. No. 345,518, to Lelievre; U.S. Pat. No. 679,144, to Hardesty; U.S. Pat. No. 834,014, to Lyke; U.S. Pat. No. 1,600,804 to Donaldson; U.S. Pat. No. 2,156,313, and to U.S. Pat. No. 2,239,275 Schwab; U.S. Pat. No. 2,610,755, to Gits; U.S. Pat. No. 2,742,168, to Panetti; U.S. Pat. No. 2,744,696, to Blackstone; U.S. Pat. No. 3,059,707, to Wilkinson, et al; U.S. Pat. No. 5,570,796, to Brown, et al. In addition British patents No. 273,185 and No. 454,053 show related developments.

The present art overcomes the limitations of the prior art, that is nipple vented bottles, where a need exists for reducing vacuum inside nursing bottles using vent tubes. That is, the art of the present invention, a tapering vent tube allows air to exit rapidly and distally from a tube and liquid to return promptly to a reservoir thus limiting the formation of a vacuum within a nursing bottle. The enlarged proximal portion of the vent tube minimizes the incidence of leakage from the bottle. The present invention cleans easily, endures inadvertent chewing, and dissipates pressure generated by chewing. The present invention prevents leaks and continuously vents a bottle, including an angled bottle, thus dissipating any air bubbles in the vent tube.

SUMMARY OF THE INVENTION

Accordingly, the present invention improves the vent tube within an angled nursing bottle by changing the shape of the vent tube. The vent tube has a contoured shape generally and preferably attains a conical shape with the diameter of the cone larger superiorly and smaller inferiorly, towards the lower end of the angled bottle. The conical shape admits air distally into a bottle while immediately emptying liquid itself into the reservoir of the vent tube. The conical shape prevents entry of liquid into an insert thus venting the bottle immediately and preventing leaks of liquid from the bottle.

Additionally, the present invention provides an improved shape of the vent tube to lower internal pressures of liquids and air. Decreased transmission of pressure from nipple compression is noted at the widened proximal end of the vent tube. When pressure is exerted upon the milk in the bottle, and it rises up into the vent tube, the milk loses its force due to the widening characteristics of the vent tube at its upper wider reaches. The larger diameter of the conical shape prevents the liquid in the bottle from being propelled proximally into the tube of the insert and causing leaks. This is due to the larger diameter of the conical shape, at the proximal end of the tube as compared to the distal end, which dissipates the pressure of the compressed air and allows the liquid to gently flow into the reservoir. Preventing propulsion of liquid into the insert, the conical shape prevents leaks from the bottle.

Further, the larger diameter of the conical shaped section increases the capacity of the reservoir. As the infant empties the bottle and the liquid level drops below the maximum, the liquid occupying the reservoir now, more rapidly and effectively exits the reservoir. When a caregiver or infant holds the bottle upright, liquid promptly exits the reservoir into the larger diameter of the conical shaped tube and returns the remaining liquid to the bottle.

The present invention allows for instant and complete movement of any air bubble introduced by an infant chewing on a nipple to proceed to the distal end of the vent tube. Also, the present invention moves liquid—ahead of an air bubble—proximally into the reservoir of the vent tube. The vent tube hereby functions in an automatic and continuous fashion as intended.

This invention establishes a structured relationship between the container or vessel and the formula within a nursing bottle. The nursing bottle has sufficient size so that as the formula is prepared and deposited within the container, the formula's surface will be arranged below the vent port or the vent leading towards the exterior of the container, for venting purposes. In addition, even when the vessel is inverted, by the infant or caregiver, during feeding, the liquid formula still will not approach the distal insert vent in any position. Thus, the concept of this invention is to provide a container with sufficient bulk and volume, so that the formula or milk as supplied therein, whether it be in the four ounce, six ounce, eight ounce, or any size category, will always leave the identified vent port exposed to attain the attributes of venting, for the nursing bottle, at all times.

Thus, no appreciably positive or negative pressure can build up in the container, since the vent port will be opened, for exhausting purposes, when the nursing bottle is maintained in an upright direction, as while it is being warmed or heated, in preparation for a feeding, and even while the bottle may be inverted, as during a feeding, so as to allow for the venting of any negative pressure, internally generated within the container, that may occur as a result of the sucking action of the infant.

This feature of providing sufficient internal volumetric size to the container is achieved through usage of containers that are of excessive dimensions, such as being large and spherical in shape, or cylindrical in shape and flattened upon each surface, or which has a size equivalent to that of a Mason jar. In one instance, the container may be shaped in a spherical form. In another embodiment, the container will be of a cylindrical shape, but be flattened on the sides. In a further embodiment, the container may be of the jar shape, or even contain some concavity upon its sides, to facilitate its lifting. In addition, where the spherical or cylindrical type of container is used, it may have a flattened bottom, to add stability to the nursing bottle, when rested upon a surface.

In the preferred embodiment, the venting port within the insert cooperates with a vent tube, and lateral vent slots, that are built into the insert that is secured to the top of the container by means of its associated threaded collar that holds the insert, the vent tube within the vessel, and the conventional nipple, in place. The vent port within the insert associated with the vent tube may open directly and downwardly into the vessel, and it may have lateral ports to either side, so as to prevent the entrance of any formula, into the vent tube and allow venting as the container is being inverted during usage.

In a further embodiment, the container, collar, and nipple may be of the conventional type, but having the volumetric sizes from the shaped containers as previously explained, but the vent tube and port within the insert may extend through the surface of the container, rather than cooperate with the collar, in the manner as previously described in the '071 patent.

Nevertheless, the orientation of the vent port, at its entrance point, leading from its distal end to the reservoir, can be arranged somewhere centrally of the configured container, regardless what shape or structures the containers may possess, so as to allow the formulation to either be below the vent port, or above it, as the nursing bottle is either at rest, or being inverted as during usage, in the manner as previously explained.

Therefore, it is an object of the invention to provide a new and improved venting tube for angled nursing bottles of infants.

It is a further object of the present invention to dissipate the pressure upon liquid within an angled bottle, preventing introduction of liquid into the insert, thus stopping leaks.

It is a still further object of the present invention to provide immediate exit of air bubbles as a bottle is inverted.

It is a still further object of the present invention to provide an apparent increase in volume of the reservoir caused by the larger diameter of the conical shape and thus immediately emptying liquid into the reservoir.

It is a still further object of this invention to provide a volumetric sized container for use as a nursing bottle, and which incorporates an angled vent tube with a reservoir connected to an insert that is arranged approximately centrally thereof, so that the vent port within the insert avoids coverage from any of the formula or milk contained therein, either during usage when feeding the infant, or during nonusage when the bottle has been set on its base, as during storage, while heating, or when at rest.

It is an even still further object of this invention is to provide for structured means within a nursing bottle that provides for continuous venting of any pressure or vacuum generated within its container, regardless of usage or nonusage of the subject bottle.

Lastly, it is another object of this invention is to provide for the structure of a wide rimmed, or other size, collar for use with a standard wide mouth container as structured into a nursing bottle, and useful for feeding formula to an infant.

These and other objects may become more apparent to those skilled in the art upon review of the invention as described herein, and upon undertaking a study of the description of its preferred embodiment, when viewed in conjunction with the drawings.

BRIEF DESCRIPTION OF THE DRAWINGS

The same reference numerals refer to the same parts throughout the various figures.

DESCRIPTION OF THE PREFERRED EMBODIMENT

Figure 1:
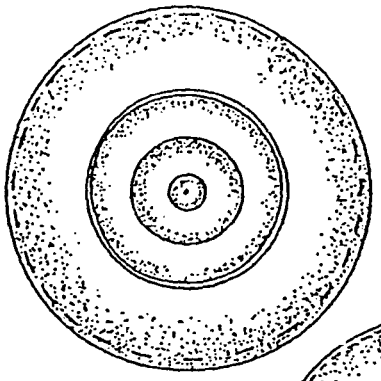
FIG. 1 is a top view of a spherical shaped nursing bottle.

The present art overcomes the prior art limitations by providing a fully vented wide rim, or other size, nursing bottle that provides a tapering vent tube to eliminate vacuum within the container and prevent leakage from the container. In referring to the drawings, and in particular FIGS. 1 and 2, the fully vented, wide rim, or other size, nursing bottle preceding this invention is disclosed. It includes a spherical shaped container 1 that has ample volumetric capacity therein, so as to achieve the sought after results for this invention. That is, when a formula, such as at 2, is applied into the container, with the formula being applied at an amount that normally furnishes a feeding for the infant, it will only fill the container up to a level that is yet below the bottom of the vent tube 3, and more specifically distally to the insert and its vent port 4, as can be noted.

Thus, when the nursing bottle is not being overheated, any pressure built up within its container will be immediately vented to the atmosphere, because of the openness of the vent port 4 of the distal insert, to absorb any generated pressure, no matter how slight, and allow it to be vented to the atmosphere, externally of the shown nursing bottle. The nipple 5, the threaded collar 6, and the vent insert 7, that are threadedly applied to the upper edge of the container 1, are all fabricated in the manner as previously described in the '071 patent with the exception that these components are fabricated of a wider dimension, so as to fit upon a wide rim style of opening for the shown container 1, thereby providing the type of ample volumetric capacity for the nursing bottle, even though the standard size of nipple may be employed, to achieve the relationship between its structure, such as the insert and its vent port, and the level of any standard amount of formulation applied therein, during usage, to achieve the benefits of this invention. In addition, when the nursing bottle of this invention is inverted for feeding an infant, the formula may rise to the opposite side of the inverted container 1, but yet will have a surface level that will still be below the distal insert and its vent port 4, so that any sucking action generated by the infant, during feeding, and the formation of any vacuum, or partial thereof, within the container, during feeding, will be continuously vented by its vent port 4, through the vent tube 3, and out of the vent insert 7, as previously reviewed. It should be noted that the container 1 of this invention will obviously include a minor flattened surface, as at 8, at its bottom, to allow the free standing of this nursing bottle, as when not in use, when stored, or when being warmed or heated in preparation for consumption of its formula contents.

Figure 2A:
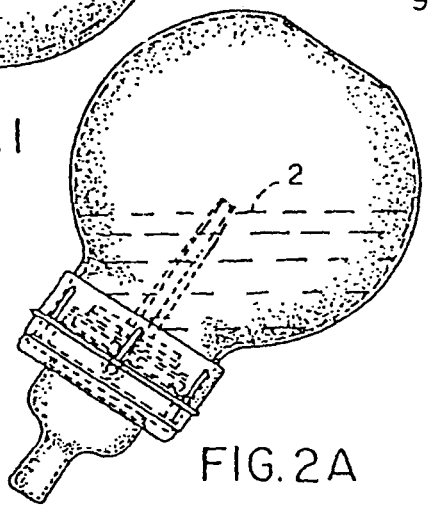
FIG. 2A is a side view of the bottle during usage.
Figure 2:
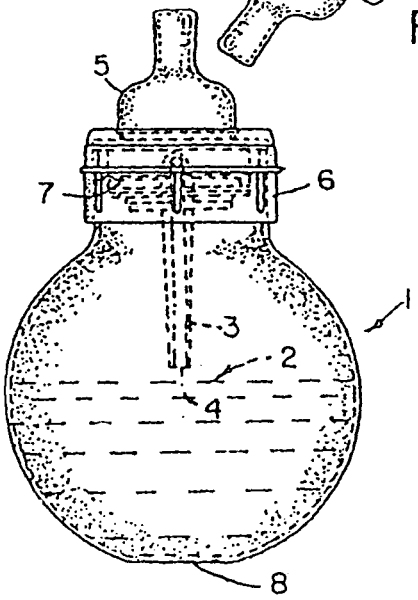
FIG. 2 is a side view thereof.

FIG. 2A shows the container 1 and its nursing bottle when inverted, as during a feeding, to disclose how the fluid level 2 will yet remain below the opened vent port 4, so as to not obstruct the venting of any partial vacuum generated therein, during the feeding process.

Figure 3:
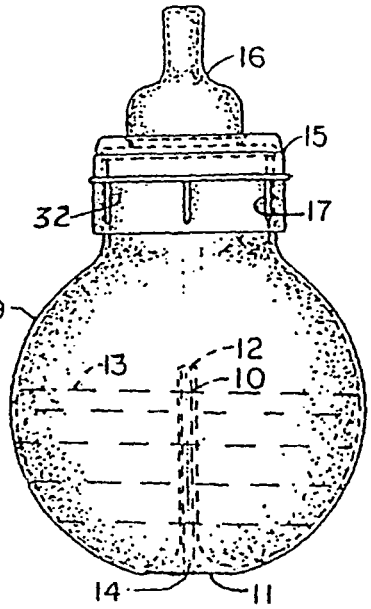
FIG. 3 shows a modification to a spherical shaped nursing bottle wherein the vent tube extends structurally upwardly from its bottom.
Figure 4:
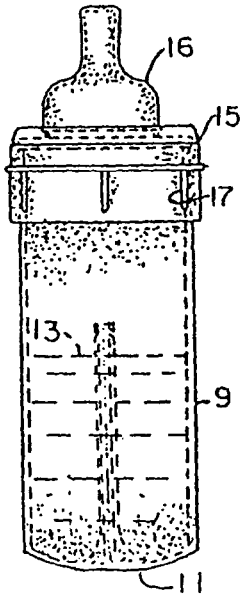
FIG. 4 is a side view of the nursing bottle of FIG. 3.

FIGS. 3 and 4 disclose a modification to the shape of the container 9 for the shown nursing bottle, with the further modification that the vent tube 10 will be integrally structured with the bottom 11 of the shown container, disposing its vent port generally centrally of the container, as can be noted at 12. Thus, regardless at what position the container 9 of this nursing bottle may undertake, the surface level 13 of the formula will not obstruct the entrance of any air flow into the vent port 12, for venting purposes, in this case, out of the bottom opening 14 of the shown vessel. This is so regardless whether the container 9, as during storage, or feeding, may be positioned vertically, as shown in FIG. 3, or inverted, as can be understood. In this particular instance, the threaded collar 15 and nipple 16 are conventional, and threadedly engage to the wide rim 17 of the container 9, in order to enhance the volumetric capacity of the nursing bottle, during usage, and to attain the results desired and required for this particular development. In addition, the structure of wide rim container 9 is generally spherical, as can be noted in FIG. 3, but flattened on its front and back surfaces, as disclosed in FIG. 4, and yet attains the volumetric capacity for the formula, as desired and required for this development.

Figure 5:
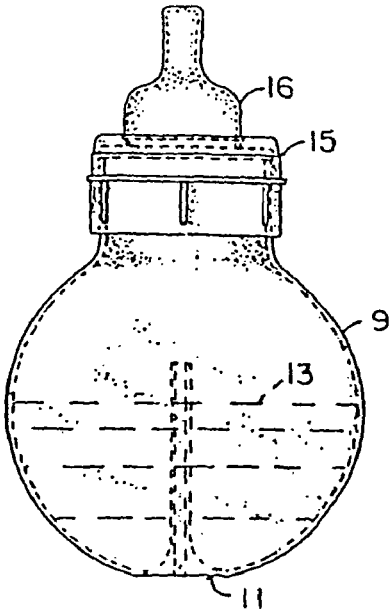
FIG. 5 is a back view of the nursing bottle of FIG. 3.
Figure 6:
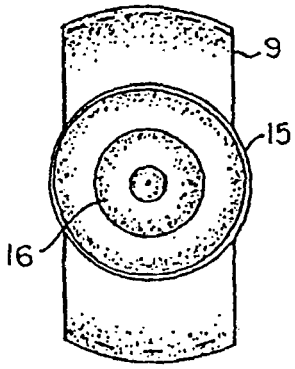
FIG. 6 is a top view thereof.
Figure 11:
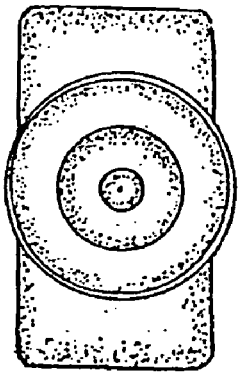
FIG. 11 is a top view thereof.
Figure 12:
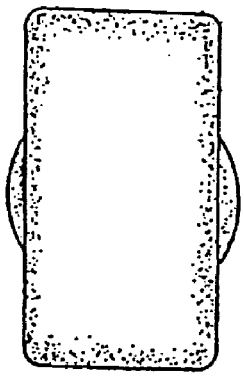
FIG. 12 is a bottom view thereof.
Figure 10:
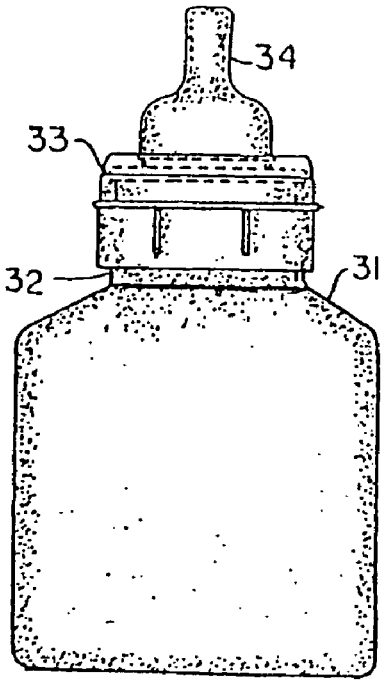
FIG. 10 is a front view of a wide structured nursing bottle of a rectangular configuration having its collar and nipple applied to a wide rim at its upper end.

FIGS. 5 and 6 provide both a back view, and top view, of the modified nursing bottle as previously described in FIGS. 3 and 4.

Figure 7:
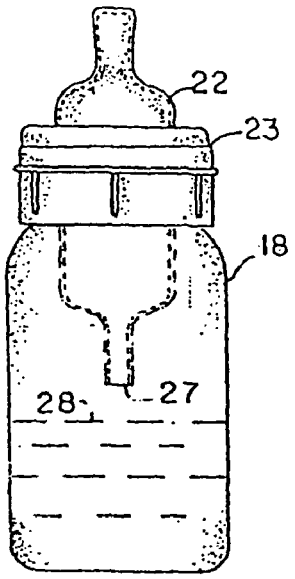
FIG. 7 is a side view of a modified form of nursing bottle having a wide rim configuration for mounting of its collar and nipple, and supporting the vent structure therein.
Figure 9:
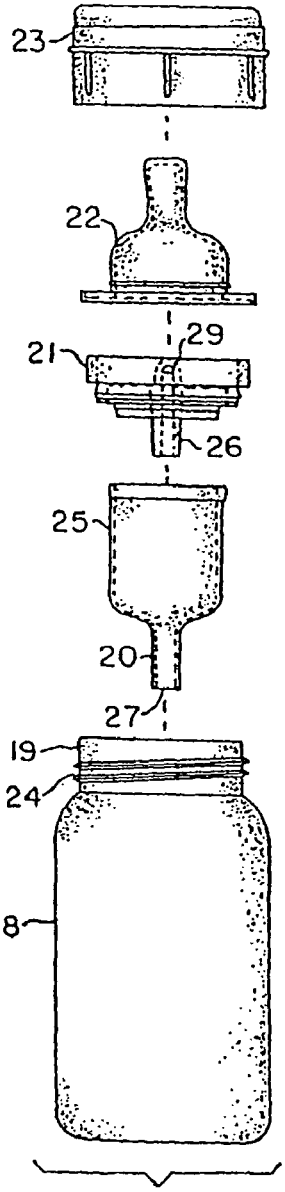
FIG. 9 is an exploded view of the operative components of the structured nursing bottle as shown in FIG. 7.
Figure 8:
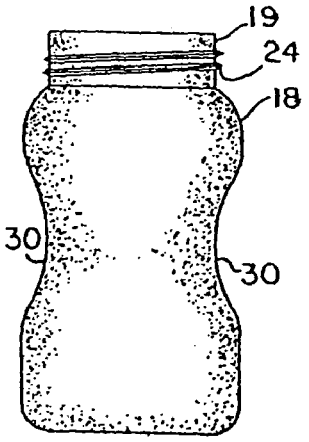
FIG. 8 is a side view of the nursing bottle as shown in FIG. 7.

FIGS. 7 through 9 show a further modified nursing bottle of this invention, wherein its container 18 has a Mason jar style of configuration, thereby affording the wide rimmed 19 style of opening, at its upper end, for accommodating the vent tube 20, receptacle portion 25, the vent insert 21, the nipple 22, and the threaded collar 23, that all threadedly engage onto the threads 24 of the shown container. These components 20 through 23 and 25 are very similar in structure to that as previously described in the '071 patent with the exception that the components are fabricated to a wider dimension, in order to be accommodated upon the wide rimmed opening 19 of the shown container 18.

The vent tube communicates with its upper inner receptacle portion 25, forming the reservoir-like configuration as noted, and which positions thereon and locates therein the internal vent tube 26 of the vent insert 21, to function in the manner as previously explained in the '071 patent. But in this particular instance, it should be noted that the vent port 27 of the vent structure, as all mounted to the wide rim of the volumetric container 18, when inserted, is disposed approximately at the center of the internal space of the shown container 18, in order to achieve the benefits and results as explained for this invention. Hence, the surface level 28 of the formula applied therein will always be below the entrance to the vent port 27, so as to avoid its blockage, regardless whether the container 18 is maintained in its rest position, as shown in FIG. 7, or when the container is tilted to any angle, or should it be inverted, placed on its side or any position, as during the feeding process. This allows the reduced pressure generated within the container, during feeding with the nursing bottle, to always be vented, to the atmosphere. In addition, it is to be noted, particularly upon review of the '071 patent, that wherever these vent tube and vent insert configurations are inserted upon the wide rim and held in position by means of the collar 23, that the distal insert and vent tube 26 internally communicate with the lateral vent passages 29 and opens to atmosphere internally of the collar 23, to provided venting thereof, at all times, to achieve the purposes and advantages of this invention.

It can also be noted in FIG. 8 that the sides of the container 18 may be integrally concaved, as at 30, for the gripping and holding of the larger sized bottle, during its usage.

Figure 13:
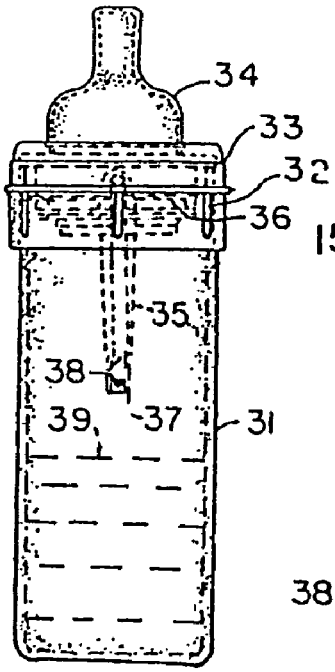
FIG. 13 is a side view thereof, and showing its internal venting structure.

FIGS. 10 through 13 disclose a larger volumetric sized nursing bottle, having a container 31 that is generally of a rectangular configuration. It has a wide rimmed opening, as at 32 for accommodating the shown collar 33, its supported nipple 34, the vent tube 35, and the vent insert 36 when installed. The vent insert is shown more carefully in FIGS. 14 and 15, and it can be seen that the bottom of the vent port 37 is open, and venting is achieved through the lateral port 38 that extends to the front and back of the insert, to attain internal venting. In addition, the lateral port 38 is arranged above the neck of the bottle. In addition, the lateral ports 38 permit the entrance of air into the feeding container as when the nursing bottle is inverted during a feeding. Nevertheless, as can be seen in FIG. 13, the level of the formula will always be at a location spaced from the bottom of the vent tube 35, to attain the purposes of this invention. Furthermore, as can be seen in FIG. 15, and as noted from the '071 and '796 patents, the vent insert 36 has the lateral vents 38 that communicate with the vent 35, for allowing the discharge of any vacuum, pressure, or the like, generated within the nursing bottle during usage, to the atmosphere, externally of the bottle, in order to achieve the benefits and results of this invention.

Figure 16:
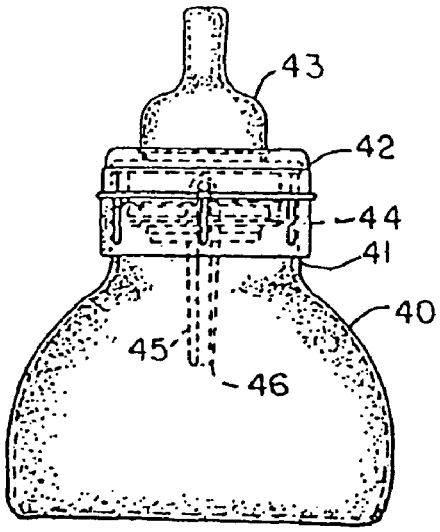
FIG. 16 is a front view of a nursing bottle having a volumetric structured vessel with the collar, vent insert and nipple applied to its wide rim top, for disposing its vent tube, and vent port approximately centrally of its shown container.

FIG. 16 shows a nursing bottle that incorporates a semi-spherical container 40, and having mounted onto its integral wide rim 41 the collar 42, nipple 43, and the vent insert 44 as noted. In addition, the vent tube 45 extends downwardly into the container 40, with the bottom 46 of the vent tube being arranged approximately, once again, at the approximate midpoint of the volumetric capacity of the nursing bottle, to achieve the benefits of this invention.

Figure 17:
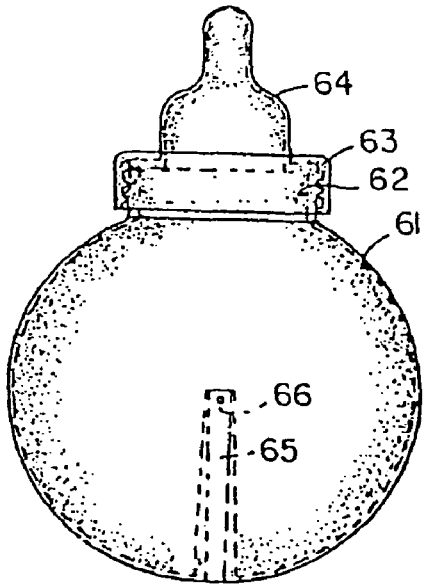
FIG. 17 is a front view of another spherical form of container for a nursing bottle having the vent tube operatively structured and disposed with its bottom segment.

FIG. 17 discloses a spherical form of nursing bottle wherein its container 61 has mounted to its wide rim 62 by threaded engagement the collar 63 and the nipple 64, as noted.

The vent tube, in this instance, as at 65, extends integrally upwardly from the bottom of the container 61, and internally vents to the atmosphere, out the bottom of the bottle, and has at its upper end the lateral vent ports 66 as noted. Again, these vent ports are arranged at the approximate midpoint of the volumetric capacity for the shown container, to achieve the benefits of this invention.

Figure 18:
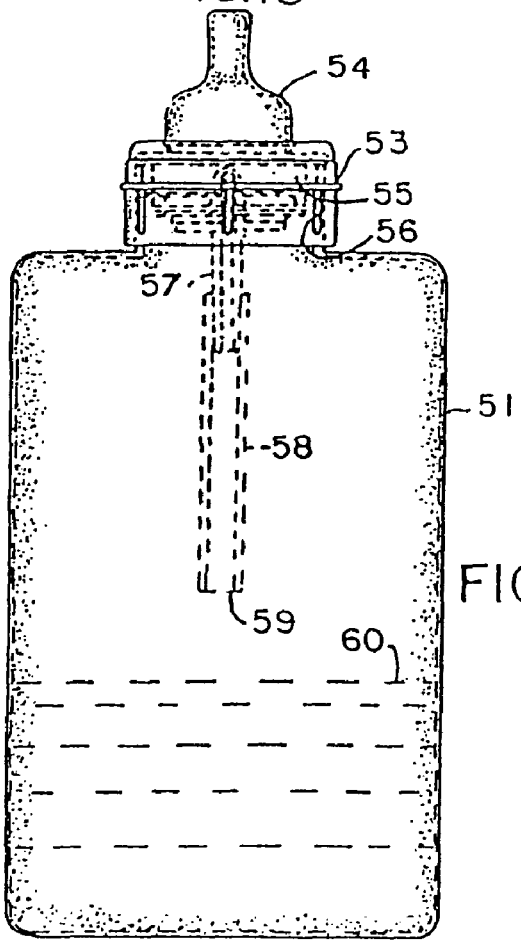
FIG. 18 is a front view of a further rectangular shaped volumetric sized container for a nursing bottle having the collar, vent insert, and vent tube, with or without an extension, all operatively associated therewith.
Figure 19:
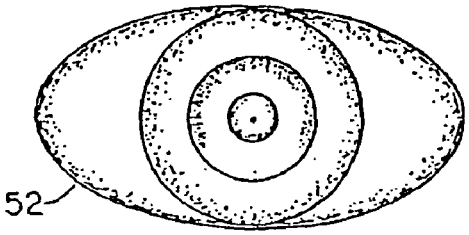
FIG. 19 is a top view of a further modified wide rim nursing bottle of this invention.

FIGS. 18 and 19 disclose a modification to the nursing bottle of this invention, wherein its container 51 is generally rectangular of configuration in one dimension, but has an oval shape 52 along its vertical disposition. Its collar 53 supports the nipple 54, and the vent insert 55 to the wide rim 56 of the integral container 51, for the nursing bottle. The distal insert and its vent tube 57 extend downwardly, and include an extended vent tube 58, whereby its vent port 59 at its bottom end is disposed approximately, once again, at the volumetric midpoint of the shown container 51 for the nursing bottle. Thus, any formula 60 contained therein for feeding, will always be below the disposition of the vent port 59, regardless whether the nursing bottle is rested upright, as shown in FIG. 18, or inverted, as during feeding.

Figure 20:
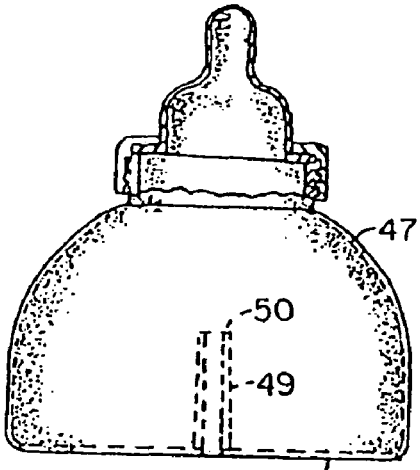
FIG. 20 is a front view thereof.

FIG. 20 shows a similar style of nursing bottle, to that of FIG. 16, but in this instance, its container 47 has integrally formed of its flattened bottom 48 an upwardly extending vent tube 49, whose upper end 50, forming the vent port, is arranged once again at the approximate volumetric midpoint of its shown container.

FIGS. 21 through 25 show variations upon the arrangement of the vent tube of this invention. As noted, in FIG. 21 the shown nursing bottle has its container 67 mounting upon its wide rim 68, its threaded collar 69, and the shown nipple 70. For venting purposes, in this particular embodiment, the vent tube 71 is integrally formed of the container 67, and extends radially inwardly, along an oblique angle, into the approximate midpoint of the shown container, having its vent port 72 disposed approximately at this location, as noted.

Thus, any formula 73 provided therein, of the amount normally fed to an infant, will always be below the entrance to the vent port 72, and not cause any leakage thereof. This is so regardless whether the nursing bottle is being stored, or inverted as during usage.

Figure 22:
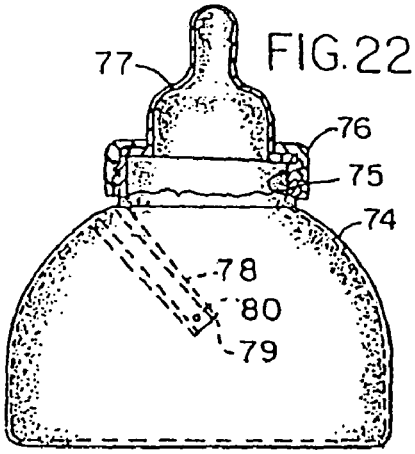
FIG. 22 is a further modified wide rim nursing bottle having its oblique vent tube extending inwardly from the approximate upper surface of its container.

FIG. 22 shows the hemispherical style of container 74 for the shown nursing bottle. The bottle has a wide rim 75, and to which the threaded collar 76 and the nipple 77 are attached.

Figure 21:
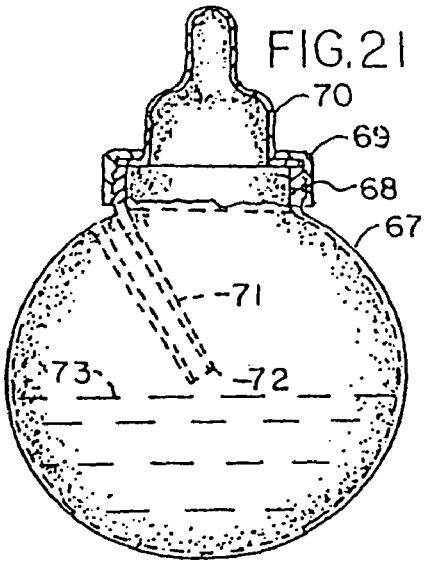
FIG. 21 is a further modified wide rim nursing bottle of this invention having its vent tube extending inwardly towards centrally from the upper container surface.

In this instance, similar to that of the bottle as described in FIG. 21, the vent tube 78 is integrally formed of the container, and is arranged obliquely within it, to dispose its vent port, as at 79, and more specifically its lateral vents 80, internally at the approximate volumetric midpoint of the shown container, to achieve the benefits of this invention.

Figure 23:
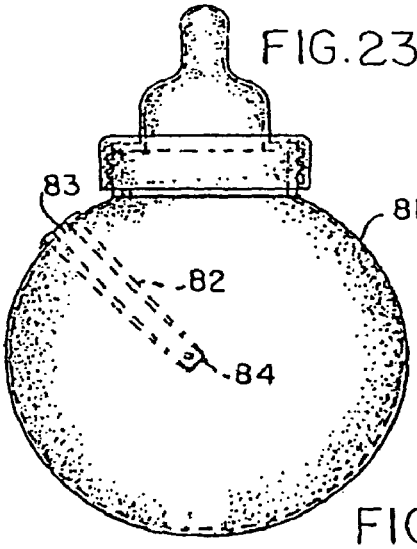
FIG. 23 is a further modified wide rim nursing bottle having the vent tube extending inwardly from the surface of its container.

FIG. 23 is similar to the structured nursing bottle as described in FIG. 21, but in this instance, as can be noted, the container 81 has its vent tube 82 arranged further down the side of the shown container, opening to atmosphere as at 83, and having its vent port 84 provided at the approximate midpoint of the shown container 81.

Figure 24:
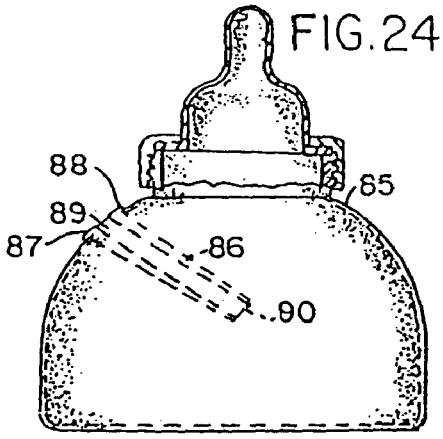
FIG. 24 is similar to the bottle of FIG. 22, with the vent tube structured further downwardly along the side of the shown bottle.

FIG. 24 shows a structure for a nursing bottle similar to that as previously explained in FIG. 22, but in this particular instance, the container 85 has its vent tube 86 integrally formed further down the side of the shown container, as can be noted at 87. This may be integrally formed, or structurally applied thereto, as by adherence of the flanges 88 to the opening 89 provided through the wall of the container 85. The inner end of the vent tube 86, has its vent port 90, arranged, once again, at the approximate volumetric midpoint of the shown container, in order to achieve the results and benefits of this invention.

Figure 25:
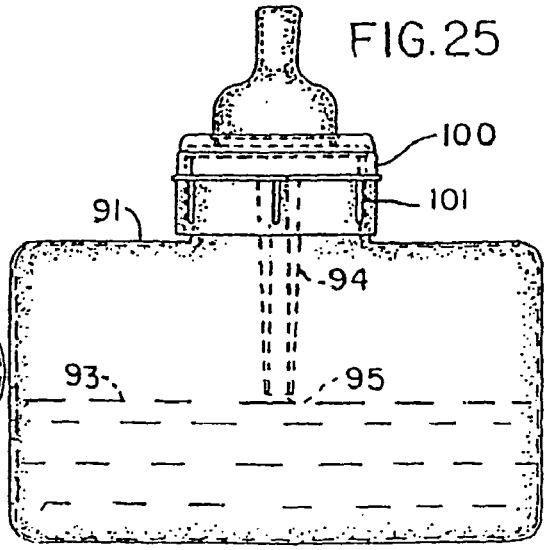
FIG. 25 is a front view of a further shaped vented nursing bottle of this invention.
Figure 26:
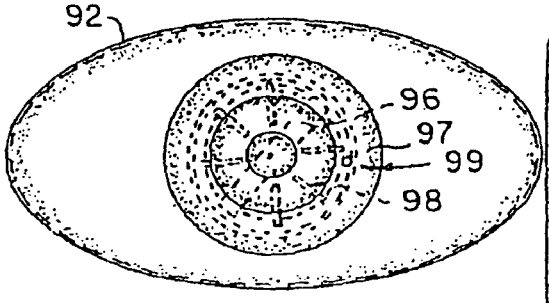
FIG. 26 is a top view of an oval shaped wide rim nursing bottle of this invention.

FIGS. 25 and 26 disclose a further modification to the nursing bottle of this invention, wherein its rectangular configured container 91 has an oval appearance along the vertical, as can be noted in FIG. 26, as at 92.

It provides sufficient volumetric capacity so that the surface of the formula added thereto, as at 93, will always be below the vent tube 94, and its vent port 95, regardless of the position undertaken by the nursing bottle, when used. In accordance with the structure of the venting characteristics of this development, and as can be seen in FIGS. 25 and 26, the vent tube 94 has lateral vents 96 that extend laterally to the sides of the vent insert 97, and which provides venting of any pressure or vacuum developed within the container 91 to the atmosphere, by passing through the configured threads 101, as can be understood from our prior patents.

As known from the '071 and '796 patents, the vent insert 97 includes a series of supporting vanes 98 that provide intermediate spacing, as at 99, and through which the formula may flow, when the nursing bottle is inverted, as during a feeding. But, the lateral vents 96 communicate with the vent tube 94, to allow passage of any pressure, or lack thereof, through said vents, to be discharged to atmosphere, by passing through the imperfect seal formed of the threaded connection between the collar 100, and the threads 101 of the wide rimmed structure of the container 91, of the shown nursing bottle. Nevertheless, the criticality regarding the location of the vent port 95, at the approximate volumetric midpoint of the shown container 91, is essential so as to prevent any leakage from it, when formula is applied therein, so that venting can effectively occur, regardless whether the nursing bottle is being used, stored, heated, or inverted, as during feeding.

Figure 14:
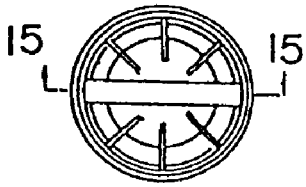
FIG. 14 is a top view of the vent insert applied within the collar when affixed to the wide rim of the container of the nursing bottle as shown in FIG. 13.
Figure 15:
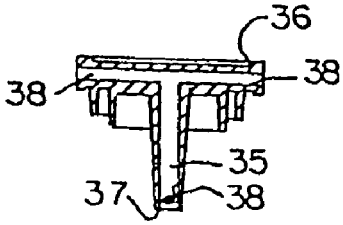
FIG. 15 is a sectional view of the vent insert, taken along the line 15-15 of FIG. 14.
Figure 27:
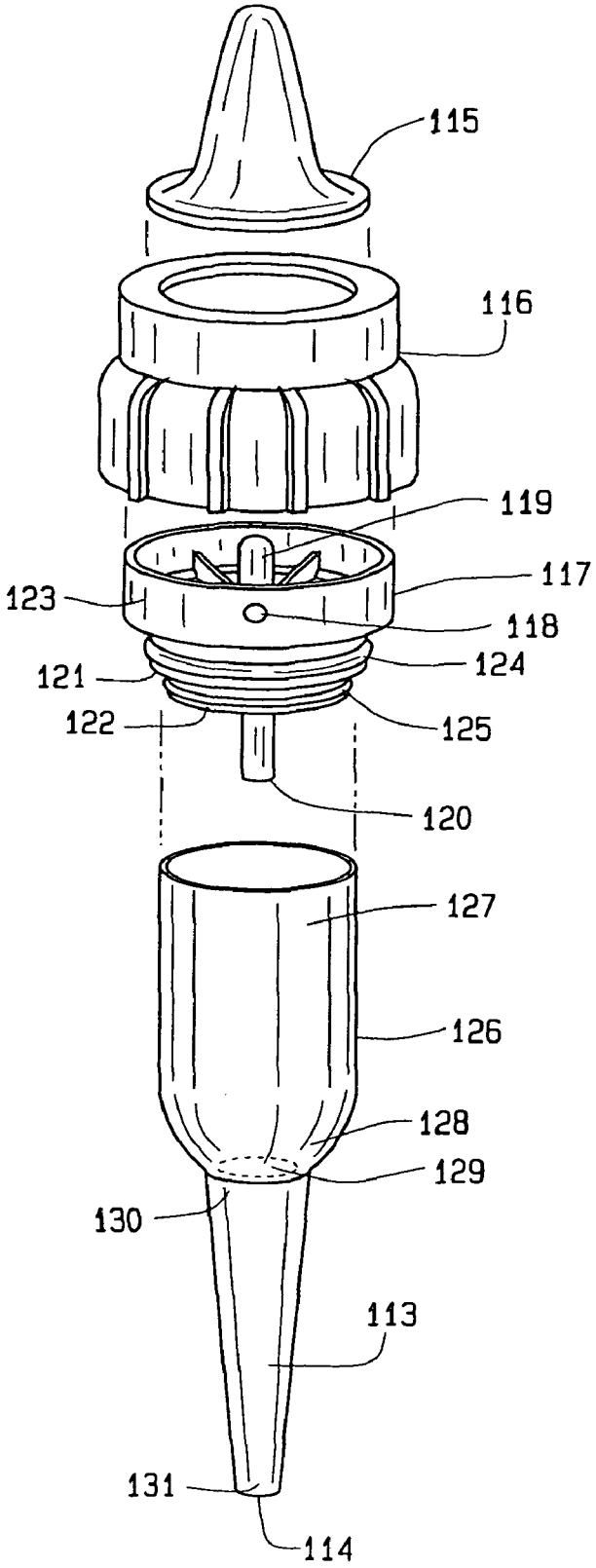
FIG. 27 is an exploded view of the vent tube and appurtenant components.
Figure 27A:
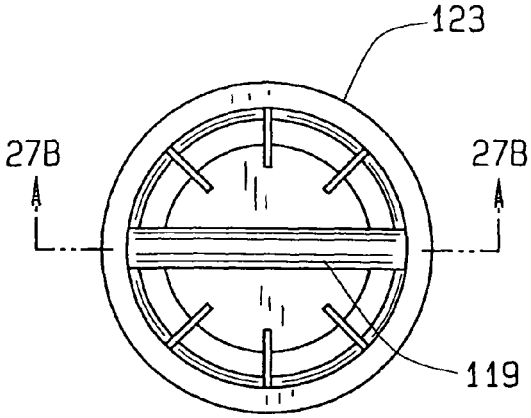
FIG. 27A is a top view of the vent insert.
Figure 27B:
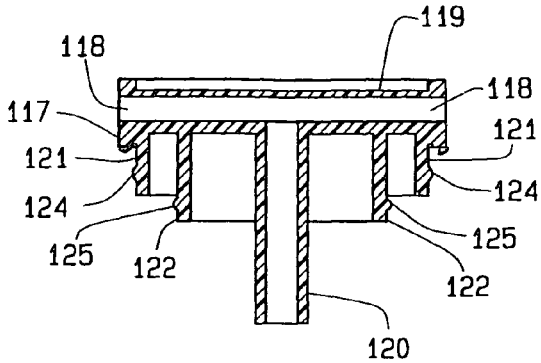
FIG. 27B is a sectional view of the vent insert.

The bottle components shown in FIG. 27 share similarities with those shown assembled previously in FIGS. 13-15. FIG. 27 shows an exploded view of the components less the liquid container or bottle. A nipple 115 extends out from a collar 116 that secures to the bottle 1. Between the collar and the bottle, a vent insert 117 grasps the rim of the bottle 1. The vent insert has a generally hollow cylindrical shape with a low height perimeter wall 123. Across the diameter, the vent insert 117 has a lateral vent 119 with a centered hole towards the direction of the bottle as shown in FIGS. 27A, 27B. The lateral vent has two opposed openings 118 the generally communicate air between the bottle 1 and the atmosphere. The insert 117 has a major lip 121 and a minor lip 122 concentric and slightly below the major lip 121 as then shown in FIG. 27B. Depending from the wall 123, the vent insert 117 has the major lip 121 also a hollow cylindrical shape contiguous but of slightly lesser diameter than the vent insert. In this manner, the vent insert can be applied in a tight seal within the rim of the bottle, during its installation, and thereby prevent any leakage from the vent insert other than the air venting desired from the structure of the insert and its applicability and usage in a nursing bottle. This aperture is provided at 114, for the contoured vent tube 113, shown here in the preferred embodiment as conical though other shapes are possible as later shown in FIG. 28. In addition, the bottom of the vent tube typically ends, in this instance, proximate to the internal bottom of any nursing bottle upon which the venting structure of this invention applies, regardless of whether it be the standard bottle, a wide rim bottle, or the like. In an alternate embodiment, the aperture 114 has a circumferential rib. The major lip has a circumferential bulge 124 of slightly larger diameter than the major lip. The bulge of the major lip seals the insert to the inner diameter of the bottle. The major lip has an outer diameter that of the inner diameter of the bottle. Depending from the lateral vent 119, the vent insert 117 has the minor lip 122 as a hollow cylindrical shape of lesser diameter than the major lip. The minor lip 122 has a circumferential bulge 125 of slightly larger diameter than the minor lip. The minor lip has an outer diameter of the inner diameter of the reservoir. The minor lip seals the reservoir 126 of the vent tube of the present invention to the vent insert 117.

The vent tube 113 has a reservoir 126 having a generally hollow cylindrical shape with an open top 127 and a partially closed bottom 128. The bottom is smoothed and rounded as it descends distally from the top. At the center of the bottom 128, an aperture 129 provides passage to the vent tube 113 joined to the bottom. The vent tube then attains a hollow truncated conical shape with the larger diameter 130 located towards the reservoir 126 and the narrow diameter 131 located distally.

Coaxial with the vent tube 113, the vent insert 117 has the distal insert or internal vent tube 120 centered upon the hole in the lateral vent 119 and perpendicular to the lateral vent 119 opposite the insert wall 123. The internal vent tube 120 is a hollow cylinder of a length in excess of its diameter. The internal vent tube 120 communicates air, but not feeding liquid in the current invention, from the lateral vent 119 into the reservoir 126 of the vent tube 113.

Figure 28:
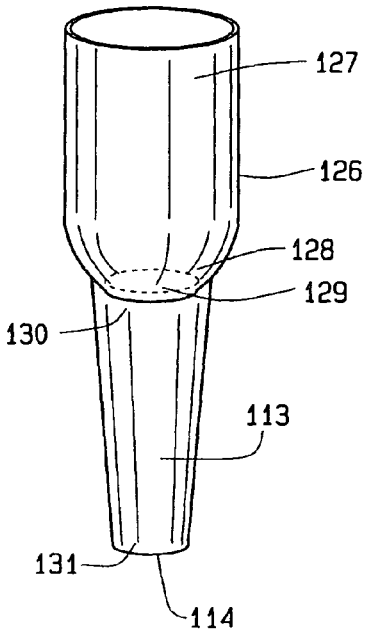
FIG. 28 is an isometric view of the vent tube having a large diameter proximally.

FIG. 28 shows the vent tube 113 alone and having a large diameter 130 proximate to and similar in diameter to the bottom 128 of the reservoir 126. The vent tube 113 then tapers distally towards the narrow diameter 131. In the preferred embodiment, the larger diameter 130 is approximately twice that of the narrow diameter 131, in a minimum ratio of about 2:1.

Figure 29:
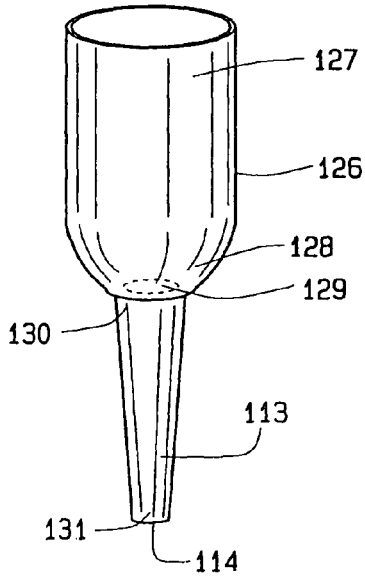
FIG. 29 is an isometric view of the vent tube having a narrow diameter distally.

FIG. 29 again shows the vent tube 113 alone but with the larger diameter 130 substantially less than previous embodiments. In this embodiment, the larger diameter 130 attains at least one eighth more than the diameter of the narrow diameter 131. Towards the narrow diameter 131, the vent tube 113 tapers distally as before. In this embodiment, the large diameter 130 is slightly greater than the narrow diameter 131, in the range of 3:1 to 1:1 ratio, here shown in a ratio of about 1.1:1.0.

Figure 30:
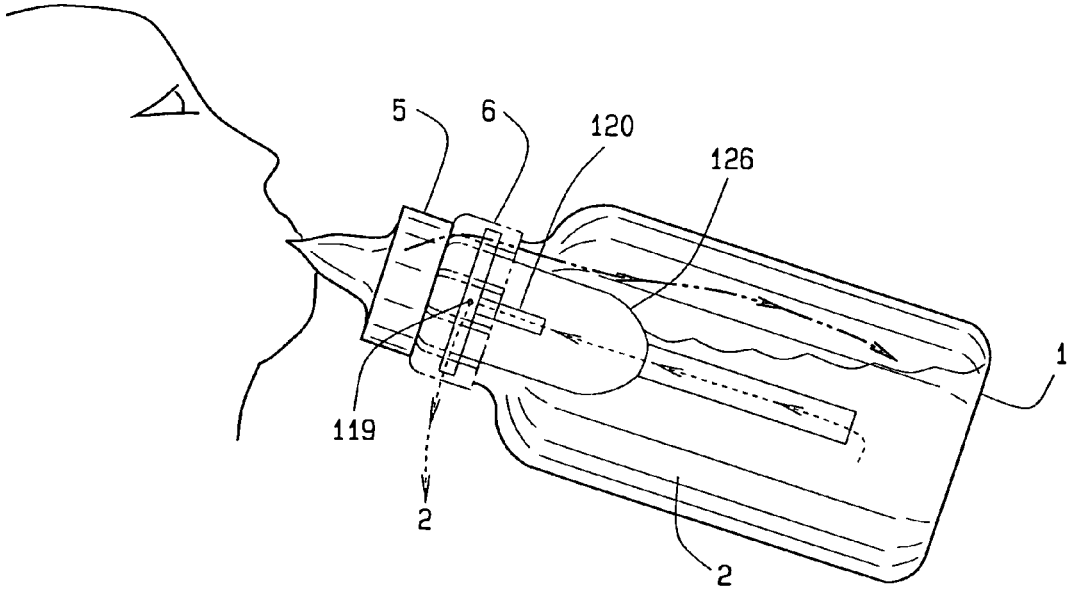
FIG. 30 PRIOR ART
FIG. 30 shows a vented bottle with a cylindrical tube and leakage during use by an infant.

FIG. 30 shows a prior art bottle in use by a chewing infant with the bottle lowered below a horizontal orientation for ready grasping by the infant. This bottle 1 has a cylindrical tube of constant diameter. With a down inclined bottle, the tube contacts the feeding liquid. When the nipple is quickly compressed, as during chewing, the compressed air above the liquid pressurizes the liquid briefly within the container. The compressed air advances from the nipple through the vanes of the insert and into the container, pressurizing it. The pressurized air forces the liquid up into the prior art vent tube having straight and constant diameter walls. The liquid in the vent tube suddenly and abruptly enters the insert where it exits the bottle through the lateral ports of the inserts. The liquid that has exited then leaks upon an infant or caregiver.

Figure 31:
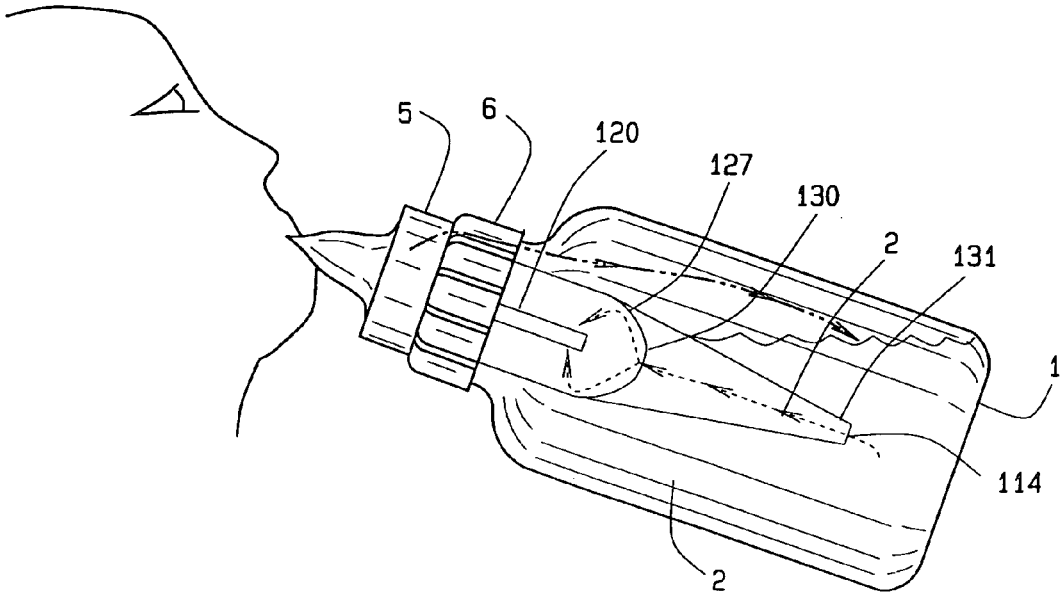
FIG. 31 shows a vented bottle with a tapering tube without a leak during use by an infant.

The tapered vent tube of the present invention, shown in FIG. 31, dissipates the feeding liquid induced into the vent tube. A conical shaped tube of dissipates the pressure upon the liquid within the tube as the tube diameter expands and the feeding liquid gently flows into the reservoir instead of forcefully leaking into the lateral tube of the insert as in the prior art. Where a bottle 1 in FIG. 31 has a vent tube of a conical shape and increasing diameter from the narrow distal end 131 to the wider proximal end 130, an infant chewing on the nipple 5 pressurizes the liquid 2 but the increasing diameter of the vent tube reduces the incremental volume inside the tube and deters feeding liquid 2 from exiting the bottle 1 at the insert 119 and leaking out of the collar 6. The increasing vent tube diameter limits any pressure increases within the bottle 1 and thus leaks from the bottle are prevented by the present invention.

Figure 32:
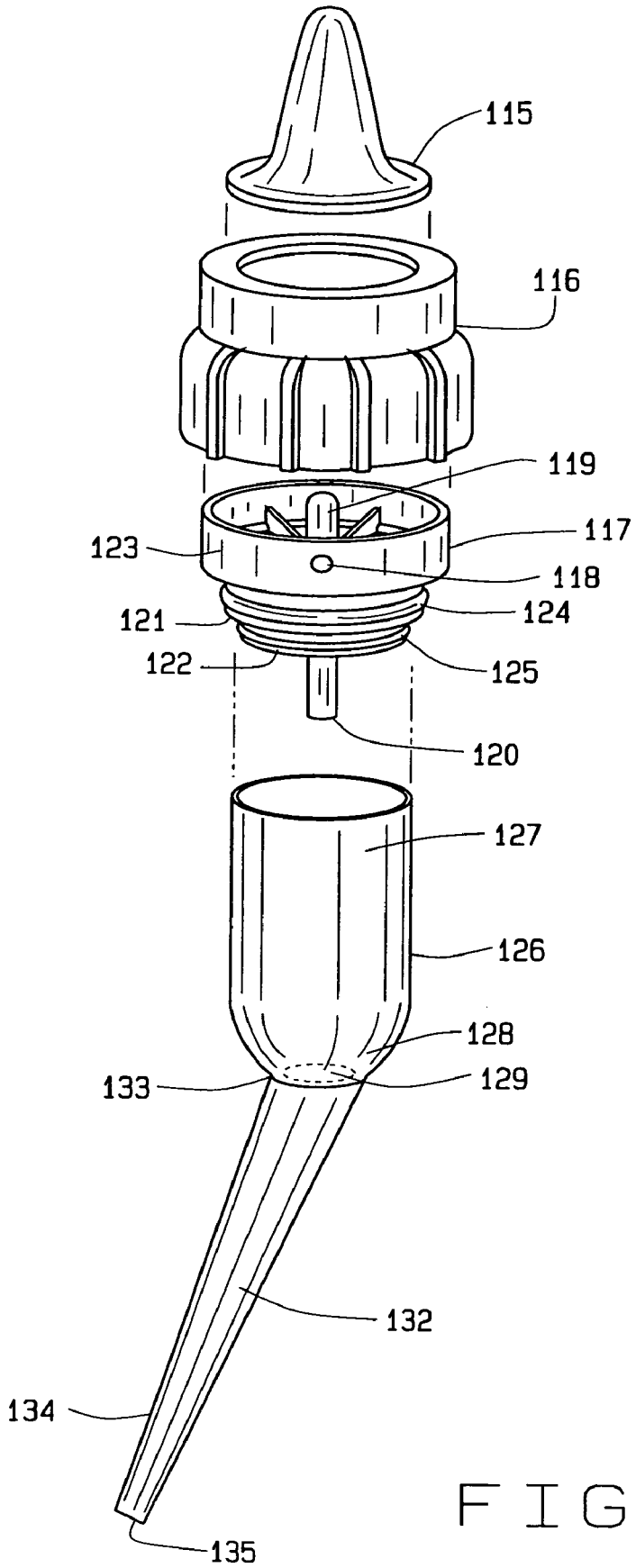
FIG. 32 is an exploded view of the vent tube of the present invention and appurtenant components.

The bottle components shown in FIG. 32 share similarities with those shown previously in FIG. 27. This embodiment of the invention appears as an exploded view of the components less the liquid container or bottle. A nipple 115 extends out from a collar 116 that secures to the bottle 1. Between the collar and the bottle, a vent insert 117 grasps the rim of the bottle 1. The vent insert has a generally hollow cylindrical shape with a low height perimeter wall. Across the diameter, the vent insert 117 has a lateral vent 119 with a centered hole towards the bottle. The lateral vent has two opposed openings that generally communicate air between the bottle 1 and the atmosphere. The insert 117 has the lips and other features thereof as previously described. In this manner, the vent insert can be applied in a tight seal within the rim of the bottle, during its installation, and thereby prevent any leakage from the vent insert other than the air venting desired from the structure of the insert and its applicability and usage in a nursing bottle. The internal vent tube 120 descends from the vent insert 117 into the reservoir 126 when the present invention is assembled. The internal vent tube 120 is a hollow cylinder of a length in excess of its diameter. The internal vent tube 120 communicates air, but not feeding liquid in the current invention, from the lateral vent 119 into the reservoir 126 of the vent tube 132. The internal vent tube 120 is generally parallel to the longitudinal axis of the reservoir.

The vent tube 132 has a reservoir 126 with a generally hollow cylindrical shape with an open top 127 and a partially closed bottom 128 as before. The bottom is smoothed and rounded as it descends distally from the top. At the center of the bottom 128, an aperture 129 provides passage to the vent tube 132 joined to the bottom. The vent tube then attains a hollow truncated conical shape at an angle to the plane of the aperture. Generally the vent tube is bent or canted unlike the previous embodiments. The cant of the vent tube matches the angle of the nursing bottle later shown in FIG. 35. The vent tube 132 is also at an angle to the internal vent tube 120. The larger diameter 133 of the vent tube is located towards the reservoir 126 and the narrow diameter 134 located distal from the reservoir. The vent tube 132 has an aperture 135 at the narrower diameter through which air vents to the bottom of the bottle.

Figure 33:
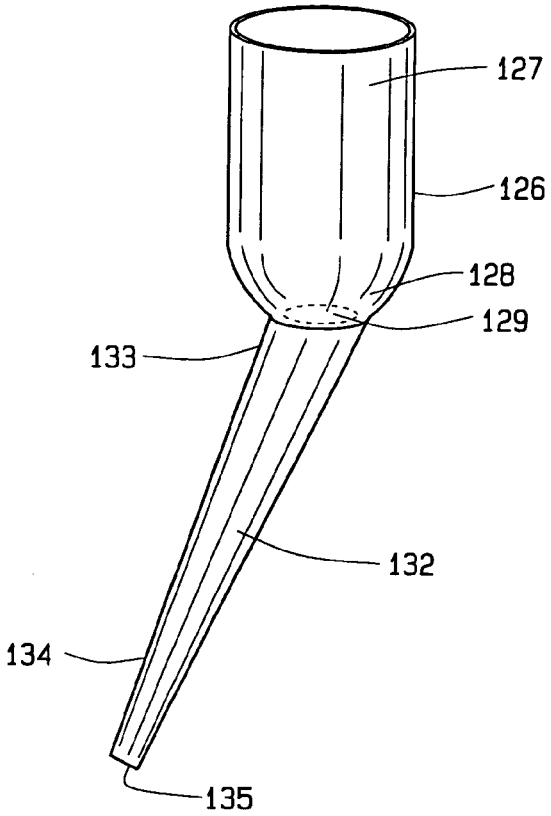
FIG. 33 is an isometric view of the vent tube having a wide diameter proximally.

FIG. 33 shows the vent tube 132 separated from the other components of the nursing bottle. The vent tube 132 has a large diameter 133 proximate to and similar in diameter to the bottom 128 of the reservoir 126. The vent tube 132 then tapers distally towards the narrow diameter 134 and outwards and away from the centerline or longitudinal axis of the reservoir. In the preferred embodiment, the vent tube has an angle of about approximately 15 to about approximately 25 degrees.

Figure 34:
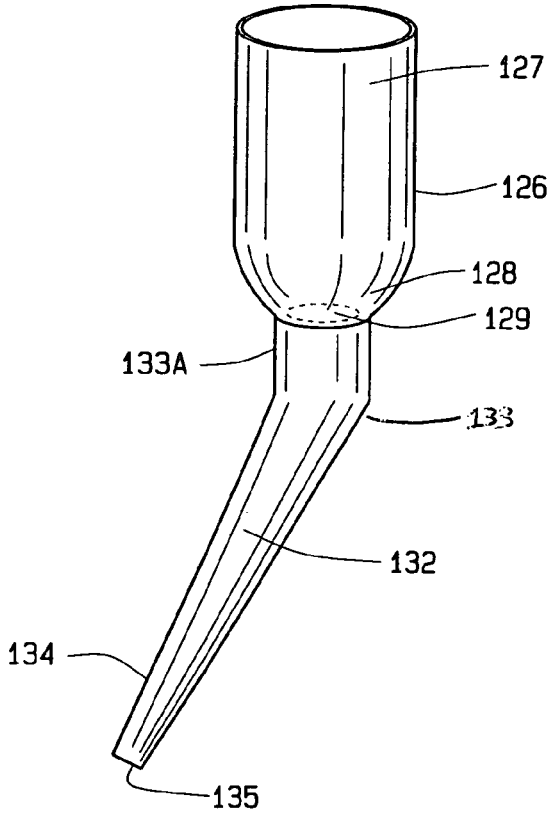
FIG. 34 is an isometric view of the vent tube having a spout proximally and the narrow diameter distally.

FIG. 34 shows the vent tube 132 again without the vent insert and other components of the nursing bottle. In this embodiment, the vent tube has a cant as before but has a spout 133A that connects to the reservoir. The spout is generally a hollow cylinder and of similar diameter to the aperture 129 of the reservoir. The spout is also coaxial with the reservoir and spaces apart the larger diameter 133 of the vent tube from the reservoir. The spacing apart aids in fitting the canted vent tube within an angled nursing bottle. As before, towards the narrow diameter 134, the vent tube 132 tapers distally and angles outward from the centerline. In this embodiment, the large diameter 133 is greater than the narrow diameter 134, generally in the range of 2:1 to 3:1.

Figure 35:
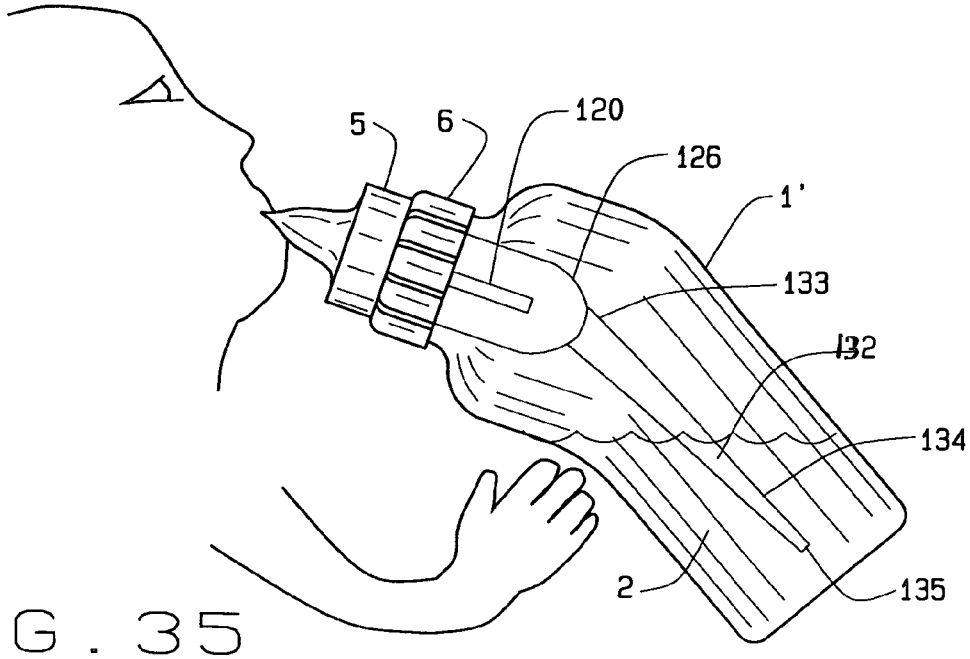
FIG. 35 shows a vented bottle with a canted tube without a leak during use by an infant.

The tapered vent tube of the present invention, shown in FIG. 35, dissipates the feeding liquid induced into the vent tube of an angled bottle. A conical shaped tube at an angle to the centerline of the bottle dissipates the pressure upon the liquid within the tube as the tube diameter expands and the feeding liquid gently flows into the reservoir instead of abruptly leaking out the vent ports as in the prior art. The cant of the vent tube maintains the aperture 135 of the tube as submerged within the feeding liquid as an infant grasps the angled bottle. The cant of the vent tube also keeps it spaced apart from the wall of the bottle. The angle of the container or bottle eases grasping of the bottle by an infant with developing motor skills. Where an angled bottle 1' in FIG. 35 has a vent tube 132 at a cant and of a conical shape and increasing diameter from the narrow distal end 134 to the wider proximal end 133, an infant chewing on the nipple 5 pressurizes the liquid 2 but the increasing diameter of the vent tube reduces the incremental volume inside the tube and deters feeding liquid 2 from exiting the bottle 1' at the insert 119 and leaking out of the collar 6. The increasing vent tube diameter limits any pressure increases within the bottle 1' and thus leaks from the bottle are prevented by the present invention.

Figure 36:
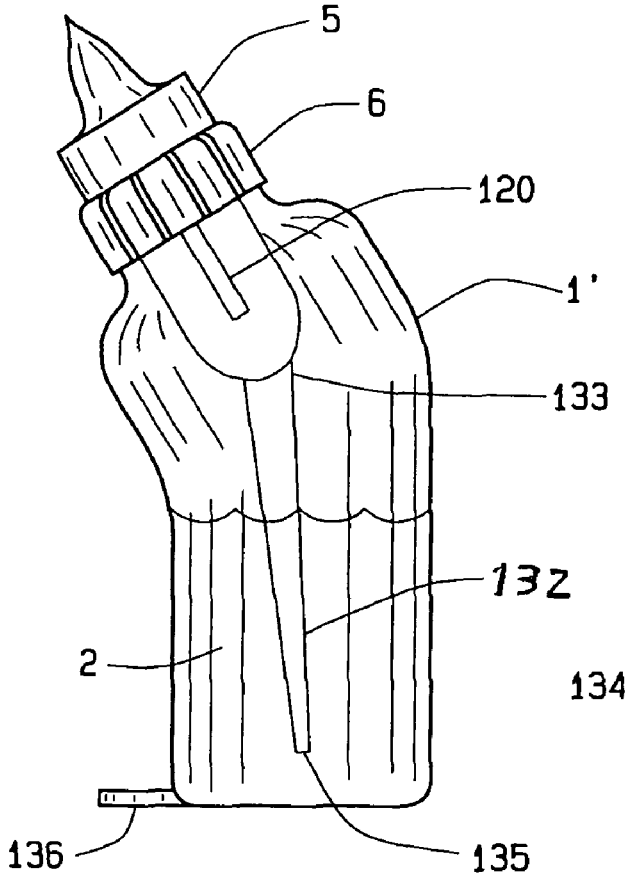
FIG. 36 describes a side view of the vented bottle with a canted tube when the vented bottle is positioned upright; and, FIG. 37 shows a bottom view of the vented bottle having a stabilizing base or foot.

The present invention appears upright in FIG. 36. The angled bottle 1' has a nipple 5 secured upon the bottle with a collar 6. The reservoir 126 connects to the vent insert 120 opposite from the nipple. The canted tube 132 used in the present invention descends from the upper portion of the bottle 1' into the feeding liquid 2 here shown in the lower portion of the bottle. This bottle has an angle that extends the nipple away from the centerline of the bottle. The extended nipple and connecting parts move the center of gravity of the bottle away from the center of the bottle. If feeding liquid rises to the upper portion of the bottle, the center of gravity of the bottle moves in the horizontal direction of the nipple. With the center of gravity moved far enough outwards, the bottle 1' has a risk of tipping. The present invention has a foot like stabilizing base 136 joined to the bottom of the bottle that extends also in the horizontal direction of the nipple. The stabilizing base extends the tipping point from the edge of the bottle to the edge of the stabilizing base. An extending tipping point reduces the risk of a full or nearly full angled bottle 1' tipping over when placed in an upright position.

Figure 37:
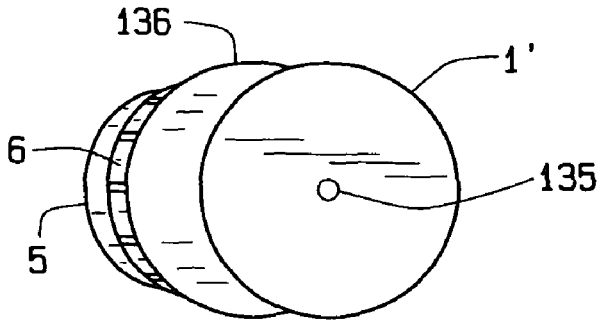

FIG. 37 shows the angled bottle 1' from the bottom with the stabilizing base 136 installed. The stabilizing base 136 joins to the bottom of the bottle 1' and provides a flat and continuous surface upon which the bottle 1' stands. In this embodiment, the stabilizing base is crescent shaped with the widest part of the crescent located upon a line between the center of the bottle, shown by the narrow diameter 135 of the vent tube, and the nipple shown partially obscured by the collar 6. The stabilizing base tapers in width until the stabilizing base approaches the bottle tangentially and two opposed points. The stabilizing base 136 itself has a generally flat planar shape with two curved, crescent shaped edges, an outer convex edge and an inner concave edge. The concave edge of the stabilizing base joins to the bottom of the bottle 1' as previously described.

From the aforementioned description, a fully vented wide rim, or other diameter, nursing bottle with a canted tube has been described. This nursing bottle is uniquely capable of reducing pressure increases within a vent tube and prevents leakage from an angled bottle. This nursing bottle and its various components may be manufactured from many different materials including but not limited to polymers, low density polyethylene, high density polyethylene, polypropylene, glass, nylon, ferrous and non-ferrous metals, their alloys, and composites.

Variations or modifications to the subject matter of this invention may occur to those skilled in the art upon reviewing the development as described herein. Such variations, if within the scope of this development, are intended to be encompassed within the principles of this invention, as explained herein. The description of the preferred embodiment, in addition to the depiction within the drawings, are set forth for illustrative purposes only.

We claim:

1. A nursing bottle assembly for feeding infants, and including a container, said container having a closed bottom end, a top end have an opening therein for receiving liquid into the interior of the container, a rim at the top end of the container also with an inner diameter defining the size of the opening, a threaded collar, a nipple, said container being at an angle to the longitudinal axis of said nipple, a vent insert to generally close and to ventilate the interior of the container during usage, said vent insert sealing to said container by said collar, a reservoir, said reservoir being of generally hollow cylindrical shape with an open top that connects with the vent insert, and a smaller opposite bottom end, said reservoir having a spout beneath communicating with said lesser diameter of said reservoir, said spout, reservoir, and nipple being axially aligned in their assembly, a vent tube, said vent tube being of conical shape, and at its upper end connecting with said spout, the opposite end of said vent tube extending into proximity with and generally near the bottom of said container, the upper part of said container being axially aligned with the longitudinal axis of said nipple and reservoir, a bottom part of the container being angled from the longitudinal axis of said reservoir at approximately between 15° to approximately 25° angle, said angled bottom part of the container being axially aligned with the angled vent tube to provide a nursing bottle that has a bottom part that is vertical arranged, and an upper part and reservoir, spout, and nipple that are angled relative to said bottom part of container.

2. The nursing bottle assembly of claim 1 further comprising:

said vent tube having a conical shape.

3. The nursing bottle assembly of claim 2 wherein said larger diameter of said vent tube is no more than the diameter of said reservoir and exceeds said narrow diameter of said vent tube.

4. The nursing bottle assembly of claim 3 wherein the ratio of said larger diameter divided by said narrow diameter is at least two.

5. The nursing bottle assembly of claim 3 wherein the ratio of said larger diameter divided by said narrow diameter is less than two.

6. The nursing bottle assembly of claim 1 further comprising:

a stabilizing base, extending outwards from said bottle generally in the horizontal direction of said nipple, and joining to the bottom of said bottle generally coplanar with the bottom.

7. The container for nursing infants of claim 1 further comprising:

said vent tube having a conical shape, a larger diameter proximally and a narrow diameter distally and offset from said larger diameter and disposed generally near said bottom end of said container; and, said reservoir having a generally hollow cylindrical shape with an open top and an opposite smaller bottom end.

8. The container for nursing infants of claim 7 further comprising:

said reservoir having a spout beneath communicating to said larger diameter of said vent tube, and said spout having a generally cylindrical shape of lesser diameter than said reservoir and coaxial with said reservoir.

9. The container for nursing infants of claim 1 further comprising:

a stabilizing base, joining to the bottom end of said bottle generally coplanar with the bottom, and extending outwards from said bottle generally in the horizontal direction of said nipple.

* * * * *